US010909995B2

(12) United States Patent
Clark

(10) Patent No.: US 10,909,995 B2
(45) **Date of Patent: *Feb. 2, 2021**

(54) SYSTEMS AND METHODS FOR ENCODING AN AUDIO SIGNAL USING CUSTOM PSYCHOACOUSTIC MODELS

(71) Applicant: Mimi Hearing Technologies GmbH, Berlin (DE)

(72) Inventor: Nicholas R. Clark, Royston (GB)

(73) Assignee: Mimi Hearing Technologies GmbH, Berlin (DE)

( * ) Notice: Subject to any disclaimer, the term of this patent is extended or adjusted under 35 U.S.C. 154(b) by 174 days.

This patent is subject to a terminal disclaimer.

(21) Appl. No.: 16/206,458

(22) Filed: Nov. 30, 2018

(65) Prior Publication Data

US 2020/0027467 A1 Jan. 23, 2020

Related U.S. Application Data

(60) Provisional application No. 62/701,350, filed on Jul. 20, 2018, provisional application No. 62/719,919, filed on Aug. 20, 2018, provisional application No. 62/721,417, filed on Aug. 22, 2018.

(30) Foreign Application Priority Data

Nov. 23, 2018 (EP) ..... 18208017

(51) Int. Cl.

| | |
|---|---|
| ***G10L 19/00*** | (2013.01) |
| ***G10L 19/02*** | (2013.01) |
| ***G10L 19/032*** | (2013.01) |
| ***G10L 19/087*** | (2013.01) |
| ***H04R 3/04*** | (2006.01) |

(52) U.S. Cl.

CPC ..... *G10L 19/0204* (2013.01); *G10L 19/032* (2013.01); *G10L 19/087* (2013.01); *H04R 3/04* (2013.01); *H04R 2420/01* (2013.01)

(58) Field of Classification Search

CPC ..... H04R 25/00; H04R 25/45; H04R 25/48; H04R 25/505; G10L 19/032; G10L 19/02; G10L 19/0204; G10L 21/0364

See application file for complete search history.

(56) References Cited

U.S. PATENT DOCUMENTS 6,327,366 B1 * 12/2001 Uvacek ..... H04R 25/70 381/312
10,455,335 B1 * 10/2019 Clark ..... G10L 19/02
10,687,155 B1 * 6/2020 Clark ..... H04R 25/305

(Continued)

FOREIGN PATENT DOCUMENTS

WO WO-2018069900 A1 * 4/2018 ..... G10L 21/0232

*Primary Examiner* — Edgar X Guerra-Erazo
(74) *Attorney, Agent, or Firm* — Polsinelli PC

(57) ABSTRACT

Systems and methods are provided for modifying an audio signal using custom psychoacoustic methods, for encoding the audio signal. A user's hearing profile is first obtained. Subsequently, a sample of the audio signal is split into frequency components. Next, masking and hearing thresholds are obtained from the user's hearing profile and applied to the frequency components of the audio sample, wherein the user's perceived data is calculated. User's imperceptible audio signal data is then disregarded. The audio sample is quantized and the resulting transformed audio sample encoded.

15 Claims, 15 Drawing Sheets

(56) References Cited

U.S. PATENT DOCUMENTS

| | | | | |
|---|---|---|---|---|
| 2003/0064746 | A1 | 4/2003 | Rader et al. | |
| 2003/0182000 | A1 | 9/2003 | Muesch et al. | |
| 2011/0026724 | A1* | 2/2011 | Doclo | H04R 1/1083 381/71.8 |
| 2011/0035212 | A1* | 2/2011 | Briand | G10L 19/0204 704/203 |
| 2012/0023051 | A1* | 1/2012 | Pishehvar | G06N 3/049 706/21 |
| 2012/0183165 | A1* | 7/2012 | Foo | H04R 25/50 381/314 |
| 2020/0029158 | A1* | 1/2020 | Clark | H04R 5/04 |
| 2020/0029159 | A1* | 1/2020 | Clark | H03G 9/005 |

* cited by examiner $$\mathrm{Bark}(f) = 13\arctan(0.0007f) + 3.5\arctan\left(\left(\frac{f}{7500}\right)^2\right)$$

201

PRI (IV+V+VI) > PRI (I+II+III)

SYSTEMS AND METHODS FOR ENCODING AN AUDIO SIGNAL USING CUSTOM PSYCHOACOUSTIC MODELS

CROSS-REFERENCE TO RELATED APPLICATIONS

This Non-Provisional application claims priority to European Application No. 18208017.6, filed Nov. 23, 2018, which claims priority to U.S. Provisional Application No. 62/701,350 filed Jul. 20, 2018, U.S. Provisional Application No. 62/719,919 filed Aug. 20, 2018, and U.S. Provisional Application No. 62/721,417 filed Aug. 22, 2018, and which is entirely incorporated by reference herein.

FIELD OF INVENTION

This invention relates generally to the field of audio engineering, psychoacoustics, digital signal processing and encoding—more specifically systems and methods for modifying an audio signal for encoding and/or replay on an audio device, for example for providing an improved listening experience on an audio device and/or for improved lossy compression of an audio file according to a user's individual hearing profile.

BACKGROUND

Perceptual coders work on the principle of exploiting perceptually relevant information ("PRI") to reduce the data rate of encoded audio material. Perceptually irrelevant information, information that would not be heard by an individual, is discarded in order to reduce data rate while maintaining listening quality of the encoded audio. These "lossy" perceptual audio encoders are based on a psychoacoustic model of an ideal listener, a "golden ears" standard of normal hearing. To this extent, audio files are intended to be encoded once, and then decoded using a generic decoder to make them suitable for consumption by all. Indeed, this paradigm forms the basis of MP3 encoding, and other similar encoding formats, which revolutionized music file sharing in the 1990's by significantly reducing audio file sizes, ultimately leading to the success of music streaming services today.

PRI estimation generally consists of transforming a sampled window of audio signal into the frequency domain, by for instance, using a fast Fourier transform. Masking thresholds are then obtained using psychoacoustic rules: critical band analysis is performed, noise-like or tone-like regions of the audio signal are determined, thresholding rules for the signal are applied and absolute hearing thresholds are subsequently accounted for. For instance, as part of this masking threshold process, quieter sounds within a similar frequency range to loud sounds are disregarded (e.g. they fall into the quantization noise when there is bit reduction, as well as quieter sounds immediately following loud sounds within a similar frequency range. Additionally, sounds occurring below absolute hearing threshold are removed. Following this, the number of bits required to quantize the spectrum without introducing perceptible quantization error is determined. The result is approximately a ten-fold reduction in file size.

However, the "golden ears" standard, although appropriate for generic dissemination of audio information, fails to take into account the individual hearing capabilities of a listener. Indeed, there are clear, discernable trends of hearing loss with increasing age (see FIG. 1). Although hearing loss typically begins at higher frequencies, listeners who are aware that they have hearing loss do not typically complain about the absence of high frequency sounds. Instead, they report difficulties listening in a noisy environment and in perceiving the details in a complex mixture of sounds. In essence, for hearing impaired (HI) individuals, intense sounds more readily mask information with energy at other frequencies—music that was once clear and rich in detail becomes muddled. As hearing deteriorates, the signal-conditioning capabilities of the ear begin to break down, and thus HI listeners need to expend more mental effort to make sense of sounds of interest in complex acoustic scenes (or miss the information entirely). A raised threshold in an audiogram is not merely a reduction in aural sensitivity, but a result of the malfunction of some deeper processes within the auditory system that have implications beyond the detection of faint sounds. To this extent, the perceptually-relevant information rate in bits/s, i.e. PRI, which is perceived by a listener with impaired hearing, is reduced relative to that of a normal hearing person due to higher thresholds and greater masking from other components of an audio signal within a given time frame.

However, PRI loss may be partially reversed through the use of digital signal processing (DSP) techniques that reduce masking within an audio signal, such as through the use of multiband compressive systems, commonly used in hearing aids. Moreover, these systems could be more accurately and efficiently parameterized according to the perceptual information transference to the HI listener—an improvement to the fitting techniques currently employed in sound augmentation/personalization algorithms.

Accordingly, it is the object of this invention to provide an improved listening experience on an audio device and/or to provide more efficient lossy compression of an audio file, or dual optimization of both of these.

SUMMARY

The problems raised in the known prior art will be at least partially solved in the invention as described below. The features according to the invention are specified within the independent claims, advantageous implementations of which will be shown in the dependent claims. The features of the claims can be combined in any technically meaningful way, and the explanations from the following specification as well as features from the figures which show additional embodiments of the invention can be considered.

A broad aspect of this disclosure is to employ PRI calculations based on custom psychoacoustic models to provide an improved listening experience on an audio device and/or for more efficient lossy compression of an audio file according to a user's individual hearing profile, or dual optimization of both of these. By creating perceptual coders and optimally parameterized DSP algorithms using PRI calculations derived from custom psychoacoustic models, the presented technology improves lossy audio compression encoders as well as DSP fitting technology. In other words, by taking more of the hearing profile into account, a more effective initial fitting of the DSP algorithms to the user's hearing profile is obtained, requiring less of the cumbersome interactive subjective steps of the prior art. To this extent, the invention provides an improved listening experience on an audio device and/or improved lossy compression of an audio file according to a user's individual hearing profile, or dual optimization of both listening experience and audio data rate.

In general, the technology features systems and methods for modifying an audio signal using custom psychoacoustic models.

According to an aspect, a method for modifying an audio signal for encoding an audio file includes a) obtaining a user's hearing profile. In one embodiment, the user's hearing profile is derived from a suprathreshold test and a threshold test. The result of the suprathreshold test may be a psychophysical tuning curve and the threshold test may be an audiogram. In an additional embodiment, the hearing profile is derived from a suprathreshold test, whose result may be a psychophysical tuning curve. In a further embodiment, an audiogram is calculated from a psychophysical tuning curve in order to construct a user's hearing profile. In embodiments, the hearing profile may be estimated from the user's demographic information, such as from the age and sex information of the user (see, ex. FIG. 1). The method further includes b) splitting a portion of the audio signal into frequency components, e.g. by transforming a sample of audio signal into the frequency domain, c) obtaining masking thresholds from the user's hearing profile, d) obtaining hearing thresholds from the user's hearing profile, e) applying masking and hearing thresholds to the frequency components and disregarding user's imperceptible audio signal data, f) quantizing the audio sample, and finally g) encoding the processed audio sample. The encoded data may then be stored or transmitted to a far end. Alternatively, the signal can be spectrally decomposed using a bank of bandpass filters and the frequency components of the signal determined in this way.

Configured as above, the proposed method has the advantage and technical effect of providing more efficient perceptual coding. This is achieved by using custom psychoacoustic models that allow for enhanced compression by removal of additional irrelevant audio information.

In the above method, the user's hearing profile may be derived from a suprathreshold test. The result of the suprathreshold test may be a psychophysical tuning curve.

In the above method, the user's hearing profile may be derived from a suprathreshold test and a threshold test.

In the above method, the user's hearing profile may be derived from a psychophysical tuning curve and an audiogram. The audiogram may be derived from the psychophysical tuning curve.

In a preferred embodiment, an output audio device for playback of the encoded audio signal is selected from a list that may include: a mobile phone, a computer, a television, an embedded audio device, a pair of headphones, a hearing aid or a speaker system.

According to another aspect, a method for modifying an audio signal for encoding an audio file, wherein the audio signal has been first processed by an optimized multiband compression system, includes a) obtaining a user's hearing profile. In one embodiment, the user's hearing profile is derived from a suprathreshold test and a threshold test. The suprathreshold test may be a psychophysical tuning curve and the threshold test may be an audiogram. In an additional embodiment, the hearing profile is solely derived from a suprathreshold test, which may be a psychophysical tuning curve. In this embodiment, an audiogram is calculated from the psychophysical tuning curve in order to construct a user's hearing profile. In an additional embodiment, the hearing profile may be estimated from the user's demographic information, such as from the age and sex information of the user (see, ex. FIG. 1). The method further includes b) splitting a portion of the audio signal into frequency components, e.g. by transforming a sample of audio signal into the frequency domain, c) obtaining masking thresholds from the user's hearing profile, d) obtaining hearing thresholds from the user's hearing profile, e) applying masking and hearing thresholds to the frequency components and disregarding user's imperceptible audio signal data, f) quantizing the audio sample, and finally g) encoding the processed audio sample. Alternatively, the signal can be spectrally decomposed using a bank of bandpass filters and the frequency components of the signal determined in this way.

Configured as above, the proposed method has the advantage and technical effect of providing more efficient perceptual coding while also improving the listening experience for a user. This is achieved by using custom psychoacoustic models that allow for enhanced compression by removal of additional irrelevant audio information as well as through the optimization of a user's PRI for the better parameterization of DSP algorithms.

The user's hearing profile may be derived from at least one of a suprathreshold test, a psychophysical tuning curve, a threshold test and an audiogram as disclosed above. The user's hearing profile may also be estimated from the user's demographic information. The user's masking thresholds and hearing thresholds from his/her hearing profile may be applied to the frequency components of the audio signal, or to the audio signal in the transform domain. The PRI may be calculated (only) for the information within the audio signal that is perceptually relevant to the user.

Unless otherwise defined, all technical terms used herein have the same meaning as commonly understood by one of ordinary skill in the art to which this technology belongs.

The term "audio device", as used herein, is defined as any device that outputs audio, including, but not limited to: mobile phones, computers, televisions, hearing aids, headphones and/or speaker systems.

The term "hearing profile", as used herein, is defined as an individual's hearing data attained, by example, through: administration of a hearing test or tests, from a previously administered hearing test or tests attained from a server or from a user's device, or from an individual's sociodemographic information, such as from their age and sex, potentially in combination with personal test data. The hearing profile may be in the form of an audiogram and/or from a suprathreshold test, such as a psychophysical tuning curve.

The term "masking thresholds", as used herein, is the intensity of a sound required to make that sound audible in the presence of a masking sound. Masking may occur before onset of the masker (backward masking), but more significantly, occurs simultaneously (simultaneous masking) or following the occurrence of a masking signal (forward masking). Masking thresholds depend on the type of masker (e.g. tonal or noise), the kind of sound being masked (e.g. tonal or noise) and on the frequency. For example, noise more effectively masks a tone than a tone masks a noise. Additionally, masking is most effective within the same critical band, i.e. between two sounds close in frequency. Individuals with sensorineural hearing impairment typically display wider, more elevated masking thresholds relative to normal hearing individuals. To this extent, a wider frequency range of off frequency sounds will mask a given sound. Masking thresholds may be described as a function in the form of a masking contour. A masking contour is typically a function of the effectiveness of a masker in terms of intensity required to mask a signal, or probe tone, versus the frequency difference between the masker and the signal or probe tone. A masker contour is a representation of the user's cochlear spectral resolution for a given frequency, i.e.

place along the cochlear partition. It can be determined by a behavioral test of cochlear tuning rather than a direct measure of cochlear activity using laser interferometry of cochlear motion. A masking contour may also be referred to as a psychophysical or psychoacoustic tuning curve (PTC). Such a curve may be derived from one of a number of types of tests: for example, it may be the results of Brian Moore's fast PTC, of Patterson's notched noise method or any similar PTC methodology. Other methods may be used to measure masking thresholds, such as through an inverted PTC paradigm, wherein a masking probe is fixed at a given frequency and a tone probe is swept through the audible frequency range.

The term "hearing thresholds", as used herein, is the minimum sound level of a pure tone that an individual can hear with no other sound present. This is also known as the 'absolute threshold of hearing. Individuals with sensorineural hearing impairment typically display elevated hearing thresholds relative to normal hearing individuals. Absolute thresholds are typically displayed in the form of an audiogram.

The term "masking threshold curve', as used herein, represents the combination of a user's masking contour and a user's absolute thresholds.

The term "perceptual relevant information" or "PRI", as used herein, is a general measure of the information rate that can be transferred to a receiver for a given piece of audio content after taking into consideration what information will be inaudible due to having amplitudes below the hearing threshold of the listener, or due to masking from other components of the signal. The PRI information rate can be described in units of bits per second (bits/s).

The term "multi-band compression system", as used herein, generally refers to any processing system that spectrally decomposes an incoming audio signal and processes each subband signal separately. Different multi-band compression configurations may be possible, including, but not limited to: those found in simple hearing aid algorithms, those that include feed forward and feed back compressors within each subband signal (see e.g. commonly owned European Patent Application 18178873.8), and/or those that feature parallel compression (wet/dry mixing).

The term "threshold parameter", as used herein, generally refers to the level, typically decibels Full Scale (dB FS) above which compression is applied in a DRC.

The term "ratio parameter", as used herein, generally refers to the gain (if the ratio is larger than 1), or attenuation (if the ratio is a fraction comprised between zero and one) per decibel exceeding the compression threshold. In a preferred embodiment of the present invention, the ratio is a fraction comprised between zero and one.

The term "imperceptible audio data", as used herein, generally refers to any audio information an individual cannot perceive, such as audio content with amplitudes below hearing and masking thresholds. Due to raised hearing thresholds and broader masking curves, individuals with sensorineural hearing impairment typically cannot perceive as much relevant audio information as a normal hearing individual within a complex audio signal. In this instance, perceptually relevant information is reduced.

The term "quantization", as used herein, refers to representing a waveform with discrete, finite values. Common quantization resolutions are 8-bit (256 levels), 16-bit (65, 536 levels) and 24 bit (16.8 million levels). Higher quantization resolutions lead to less quantization error, at the expense of file size and/or data rate.

The term "frequency domain transformation", as used herein, refers to the transformation of an audio signal from the time domain to the frequency domain, in which component frequencies are spread across the frequency spectrum. For example, a Fourier transform converts the time domain signal into an integral of sine waves of different frequencies, each of which represents a different frequency component.

The phrase "computer readable storage medium", as used herein, is defined as a solid, non-transitory storage medium. It may also be a physical storage place in a server accessible by a user, e.g. to download for installation of the computer program on her device or for cloud computing.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof, which are illustrated in the appended drawings. Understand that these drawings depict only example embodiments of the disclosure and are not therefore to be considered to be limiting of its scope, the principles herein are described and explained with additional specificity and detail through the use of the accompanying drawings in which.

DETAILED DESCRIPTION

Figure 1A:
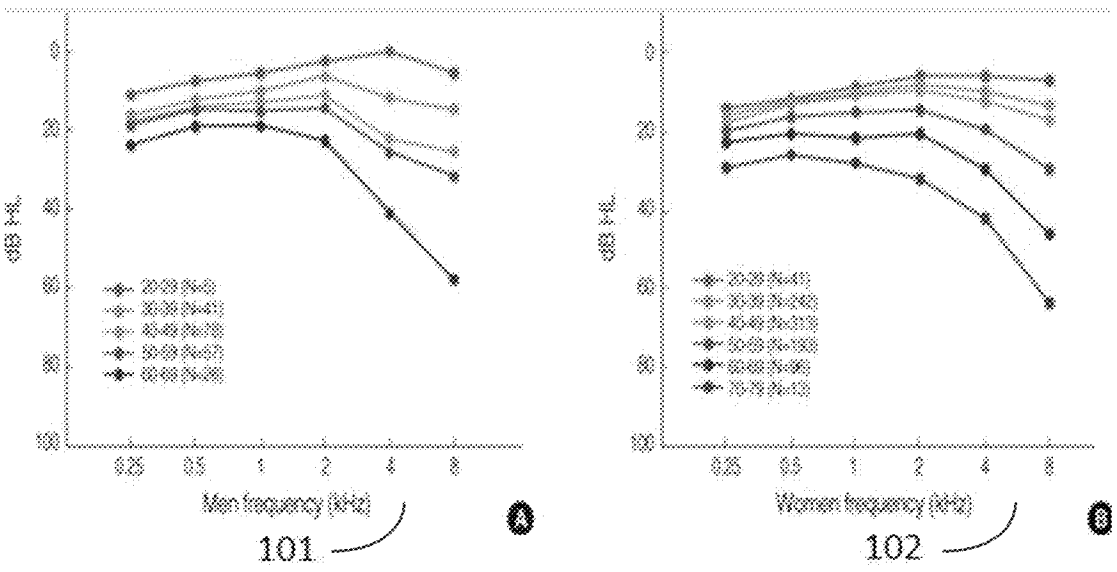
FIG. 1A illustrates representative audiograms by age group and sex in which increasing hearing loss is apparent with advancing age.

Various example embodiments of the disclosure are discussed in detail below. While specific implementations are discussed, it should be understood that these are described for illustration purposes only. A person skilled in the relevant art will recognize that other components and configurations may be used without parting from the spirit and scope of the disclosure.

The present invention relates to creating improved lossy compression encoders as well as improved parameterized audio signal processing methods using custom psychoacoustic models. Perceptually relevant information ("PRI") is the information rate (bit/s) that can be transferred to a receiver for a given piece of audio content after factoring in what information will be lost due to being below the hearing threshold of the listener, or due to masking from other components of the signal within a given time frame. This is the result of a sequence of signal processing steps that are well defined for the ideal listener. In general terms, PRI is calculated from absolute thresholds of hearing (the minimum sound intensity at a particular frequency that a person is able to detect) as well as the masking patterns for the individual.

Masking is a phenomenon that occurs across all sensory modalities where one stimulus component prevents detection of another. The effects of masking are present in the typical day-to-day hearing experience as individuals are rarely in a situation of complete silence with just a single pure tone occupying the sonic environment. To counter masking and allow the listener to perceive as much information within their surroundings as possible, the auditory system processes sound in way to provide a high bandwidth of information to the brain. The basilar membrane running along the center of the cochlea, which interfaces with the structures responsible for neural encoding of mechanical vibrations, is frequency selective. To this extent, the basilar membrane acts to spectrally decompose incoming sonic information whereby energy concentrated in different frequency regions is represented to the brain along different auditory fibers. It can be modelled as a filter bank with near logarithmic spacing of filter bands. This allows a listener to extract information from one frequency band, even if there is strong simultaneous energy occurring in a remote frequency region. For example, an individual will be able to hear both the low frequency rumble of a car approaching whilst listening to someone speak at a higher frequency. High energy maskers are required to mask signals when the masker and signal have different frequency content, but low intensity maskers can mask signals when their frequency content is similar.

The characteristics of auditory filters can be measured, for example, by playing a continuous tone at the center frequency of the filter of interest, and then measuring the masker intensity required to render the probe tone inaudible as a function of relative frequency difference between masker and probe components. A psychophysical tuning curve (PTC), consisting of a frequency selectivity contour extracted via behavioral testing, provides useful data to determine an individual's masking contours. In one embodiment of the test, a masking band of noise is gradually swept across frequency, from below the probe frequency to above the probe frequency. The user then responds when they can hear the probe and stops responding when they no longer hear the probe. This gives a jagged trace that can then be interpolated to estimate the underlying characteristics of the auditory filter. Other methodologies known in the prior art may be employed to attain user masking contour curves. For instance, an inverse paradigm may be used in which a probe tone is swept across frequency while a masking band of noise is fixed at a center frequency (known as a "masking threshold test" or "MT test").

Figure 1B:
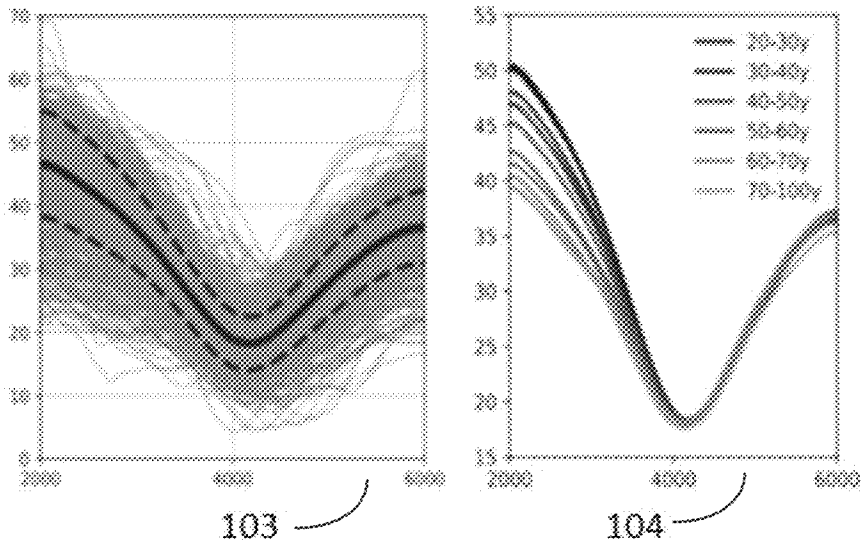
FIG. 1B illustrates a series of psychophysical tunings, which when averaged out by age, show a marked broadening of the masking contour curve.

Patterns begin to emerge when testing listeners with different hearing capabilities using the PTC test. Hearing impaired listeners have broader PTC curves, meaning maskers at remote frequencies are more effective, 104. To this extent, each auditory nerve fiber of the HI listener contains information from neighboring frequency bands, resulting in increasing off frequency masking. When PTC curves are segmented by listener age, which is highly correlated with hearing loss as defined by PTT data, there is a clear trend of the broadening of PTC with age, FIG. 1.

Figure 2:
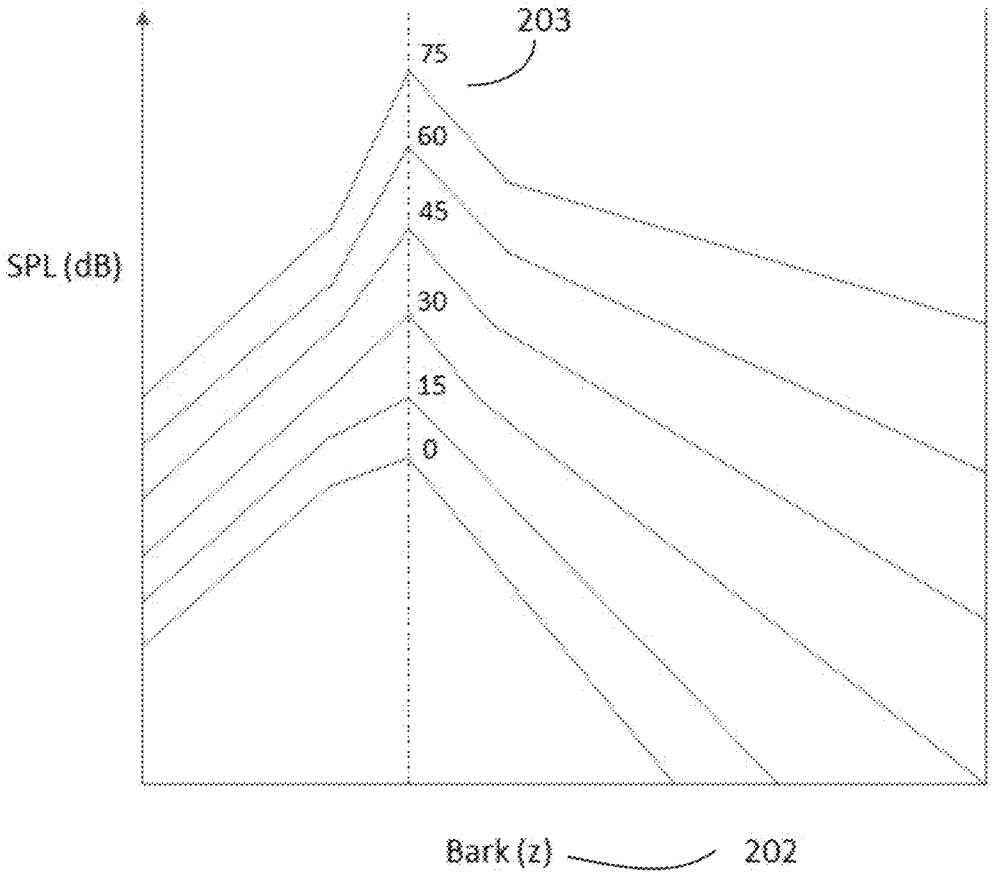
FIG. 2 illustrates a collection of prototype masking functions for a single-tone masker shown with level as a parameter.

FIG. 2 shows example masking functions for a sinusoidal masker with sound level as the parameter 203. Frequency here is expressed according to the Bark scale, 201, 202, which is a psychoacoustical scale in which the critical bands of human hearing each have a width of one Bark. A critical band is a band of audio frequencies within which a second tone will interfere with the perception of the first tone by auditory masking. For the purposes of masking, it provides a more linear visualization of spreading functions. As illustrated, the higher the sound level of the masker, the greater the amount of masking occurs across a broader expanse of frequency bands.

Figure 3:
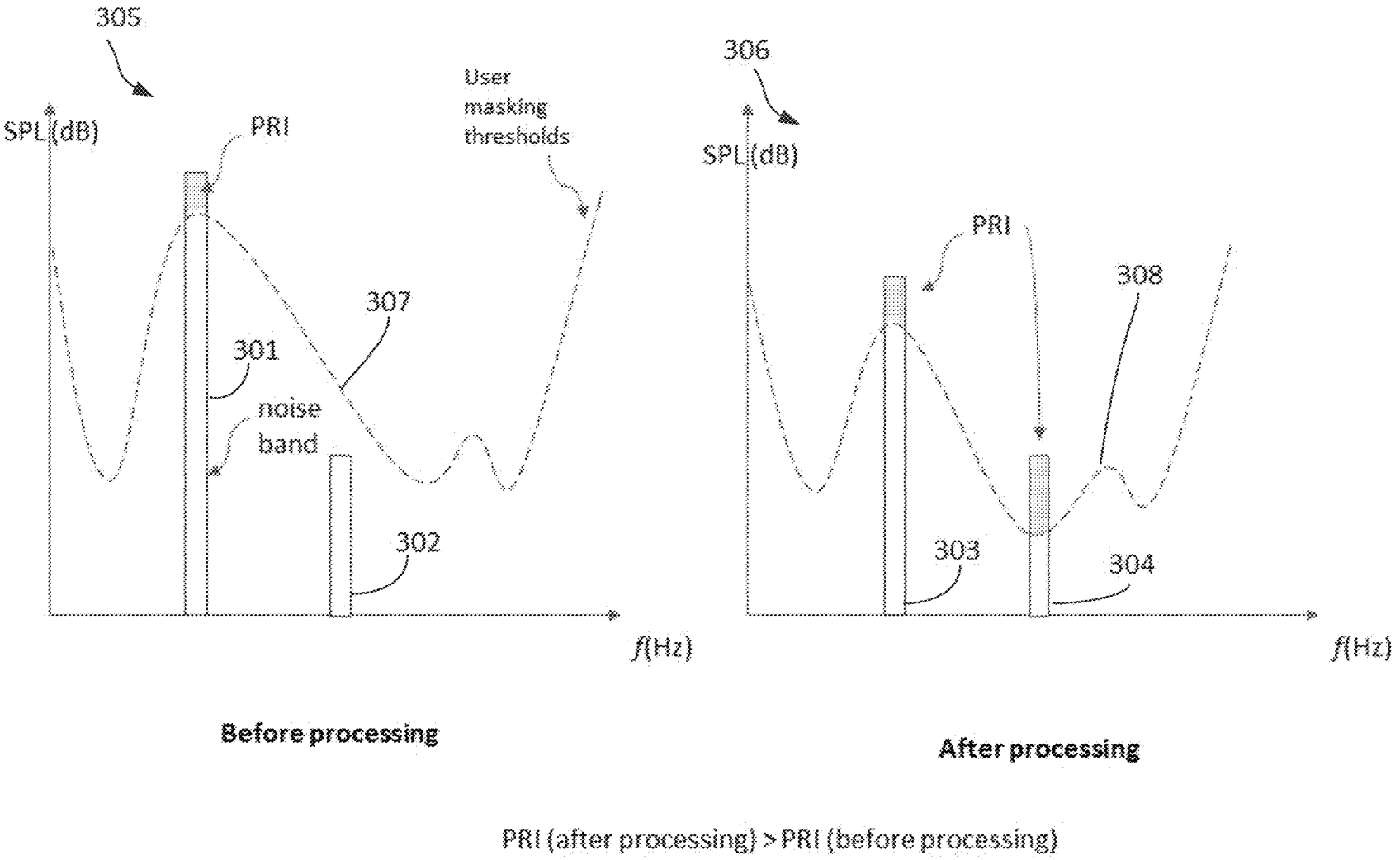
FIG. 3 illustrates an example of a simple, transformed audio signal in which compression of a masking noise band leads to an increase in PRI.

FIG. 3 shows a sample of a simple, transformed audio signal consisting of two narrow bands of noise, 301 and 302. In the first instance 305, signal 301 masks signal 302, via masking threshold curve 307, rendering signal 302 perceptually inaudible. In the second instance 306, signal component 303 is compressed; reducing its signal strength to such an extent that signal 304 is unmasked. The net result is an increase in PRI, as represented by the shaded area 303, 304 above the modified user masking threshold curve, 308.

Figure 4:
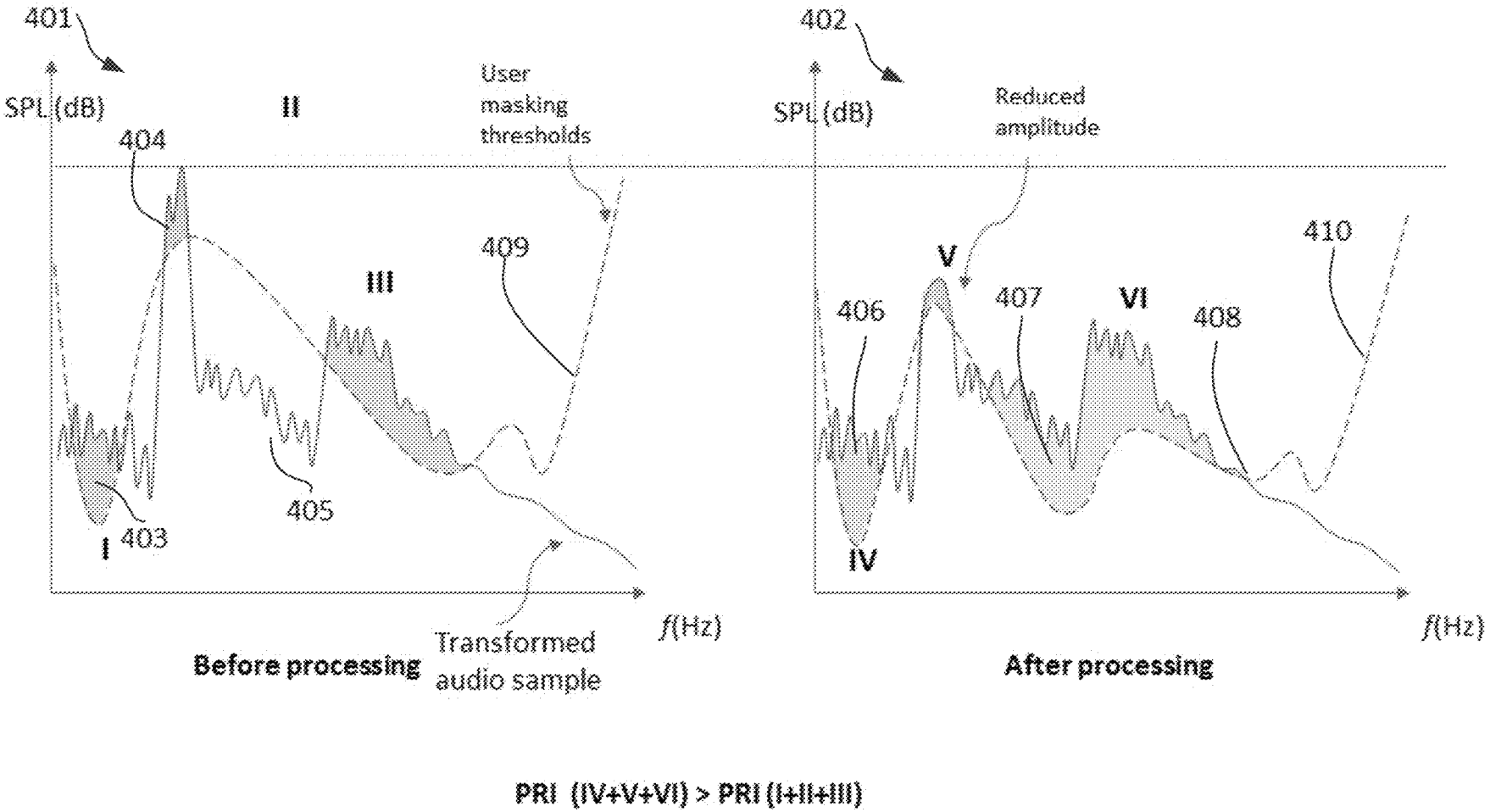
FIG. 4 illustrates an example of a more complex, transformed audio signal in which compression of a signal masker leads to an increase in PRI.
Figure 5:
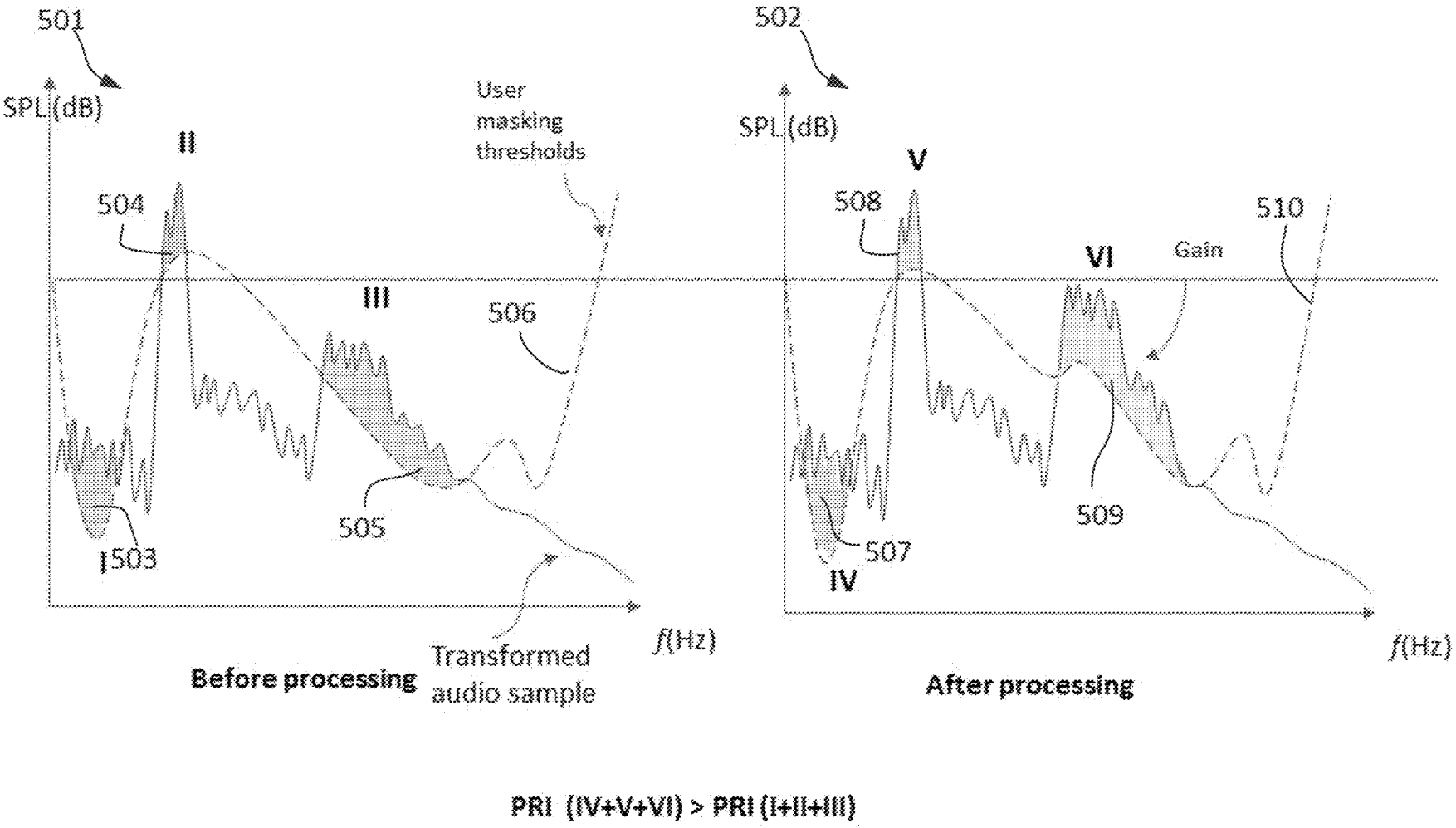
FIG. 5 illustrates an example of a complex, transformed audio signal in which increasing gain for an audio signal leads to an increase in PRI.

FIGS. 4 and 5 show a sample of a more complex, transformed audio signal. In audio sample 401, masking signal 404 masks much of audio signal 405, via masking threshold curve 409. Through compression of signal component 404 in audio sample 402, the masking threshold curve 410 changes and PRI increases, as represented by shaded areas 406-408 above the user making threshold curve, 410. Thus, the user's listening experience improves. Similarly, PRI may also be increased through the application of gain in specific frequency regions, as illustrated in FIG. 5. Through the application of gain to signal component 505, signal component 509 increases in amplitude relative to masking threshold curve 510, thus increasing user PRI. The above explanation is presented to visualize the effects of sound augmentation DSP. In general, sound augmentation DSP modifies signal levels in a frequency selective manner, e.g. by applying gain or compression to sound components to achieve the above mentioned effects (other DSP processing that has the same effect is possible as well). For example, the signal levels of high power (masking) sounds (frequency components) are decreased through compression to thereby reduce the masking effects caused by these sounds, and the signal levels of other signal components are selectively raised (by applying gain) above the hearing thresholds of the listener.

PRI can be calculated according to a variety of methods found in the prior art. One such method, also called perceptual entropy, was developed by James D. Johnston at Bell Labs, generally comprising: transforming a sampled window of audio signal into the frequency domain, obtaining masking thresholds using psychoacoustic rules by performing critical band analysis, determining noise-like or tone-like regions of the audio signal, applying thresholding rules for the signal and then accounting for absolute hearing thresholds. Following this, the number of bits required to quantize the spectrum without introducing perceptible quantization error is determined. For instance, Painter & Spanias disclose the following formulation for perceptual entropy in units of bits/s, which is closely related to ISO/IEC MPEG-1 psychoacoustic model 2 [Painter & Spanias, *Perceptual Coding of Digital Audio*, Proc. Of IEEE, Vol. 88, No. 4 (2000); see also generally Moving Picture Expert Group standards https://mpeg.chiariglione.org/standards]

$$PE = \sum_{i=1}^{25} \sum_{\omega}^{bh_i} \log_2\left\{2\left|nint\left(\frac{\mathrm{Re}(\omega)}{\sqrt{6T_i/k_i}}\right)\right|+1\right\} + \log_2\left\{2\left|nint\left(\frac{\mathrm{Im}(\omega)}{\sqrt{6T_i/k_i}}\right)\right|+1\right\}$$

Where:

i=index of critical band;

$bl_i$ and $bh_i$=upper and lower bounds of band i;

$k_i$=number of transform components in band i;

$T_i$=masking threshold in band i;

nint=rounding to the nearest integer

Re(ω)=real transform spectral components

Im(ω)=imaginary transform spectral components

Figure 6:
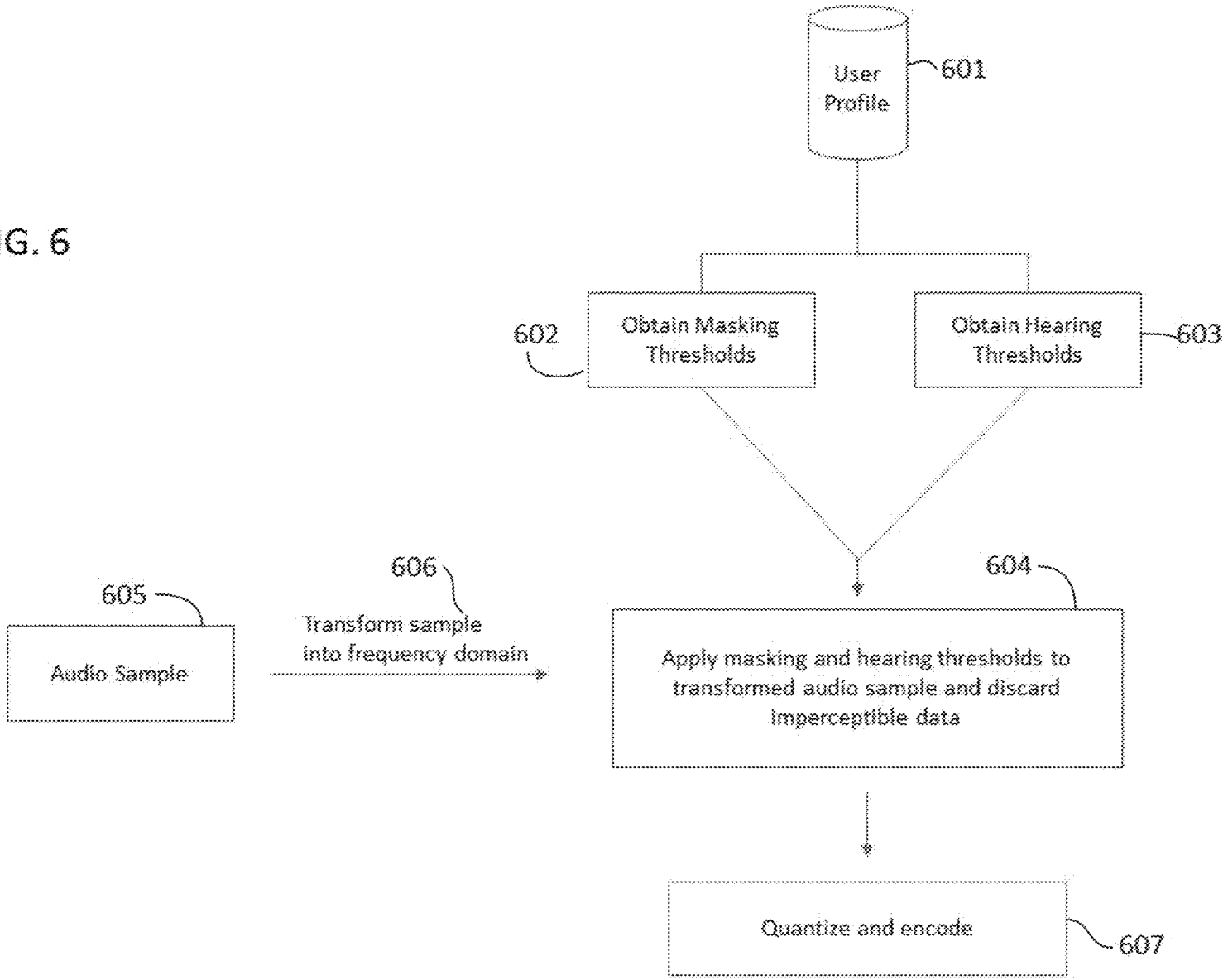
FIG. 6 illustrates a flow chart detailing perceptual encoding according to an individual hearing profile.

FIG. 6 illustrates the process by which an audio sample may be perceptually encoded according to an individual's hearing profile. First a hearing profile 601 is attained and individual masking 602 and hearing thresholds 603 are determined. Hearing thresholds may readily be determined from audiogram data. Masking thresholds may also readily be determined from masking threshold curves, as discussed above. Hearing thresholds may additionally be attained from results from masking threshold curves (as described in commonly owned EP17171413.2, entitled "Method for accurately estimating a pure tone threshold using an unreferenced audio-system"). Subsequently, masking and hearing thresholds are applied 604 to the frequency components of the audio signal, or to the transformed audio sample 605, 606 that is to be encoded, and perceptually irrelevant information is discarded. The transformed audio sample is then quantized and encoded 607. To this extent, the encoder uses an individualized psychoacoustic profile in the process of perceptual noise shaping leading to bit reduction by allowing the maximum undetectable quantization noise. This process has several applications in reducing the cost of data transmission and storage.

One application is in digital telephony. Two parties want to make a call. Each handset (or data tower to which the handset is connected) makes a connection to a database containing the psychoacoustic profile of the other party (or retrieves it directly from the other handset during the handshake procedure at the initiation of the call). Each handset (or data tower/server endpoint) can then optimally reduce the data rate for their target recipient. This would result in power and data bandwidth savings for carriers, and a reduced data drop-out rate for the end consumers without any impact on quality.

Another application is personalized media streaming. A content server can obtain a user's psychoacoustic profile prior to beginning streaming. For instance the user may offer their demographic information, which can be used to predict the user's hearing profile. The audio data can then be (re)encoded at an optimal data rate using the individualized psychoacoustic profile. The invention disclosed allows the content provider to trade off server-side computational resources against the available data bandwidth to the receiver, which may be particularly relevant in situations where the endpoint is in a geographic region with more basic data infrastructure.

A further application may be personalized storage optimization. In situations where audio is stored primarily for consumption by a single individual, then there may be benefit in using a personalized psychoacoustic model to get the maximum amount of content into a given storage capacity. Although the cost of digital storage is continually falling, there may still be commercial benefit of such technology for consumable content. Many people still download podcasts to consume which are then deleted following consumption to free up device space. Such an application of this technology could allow the user to store more content before content deletion is required.

Figure 7:
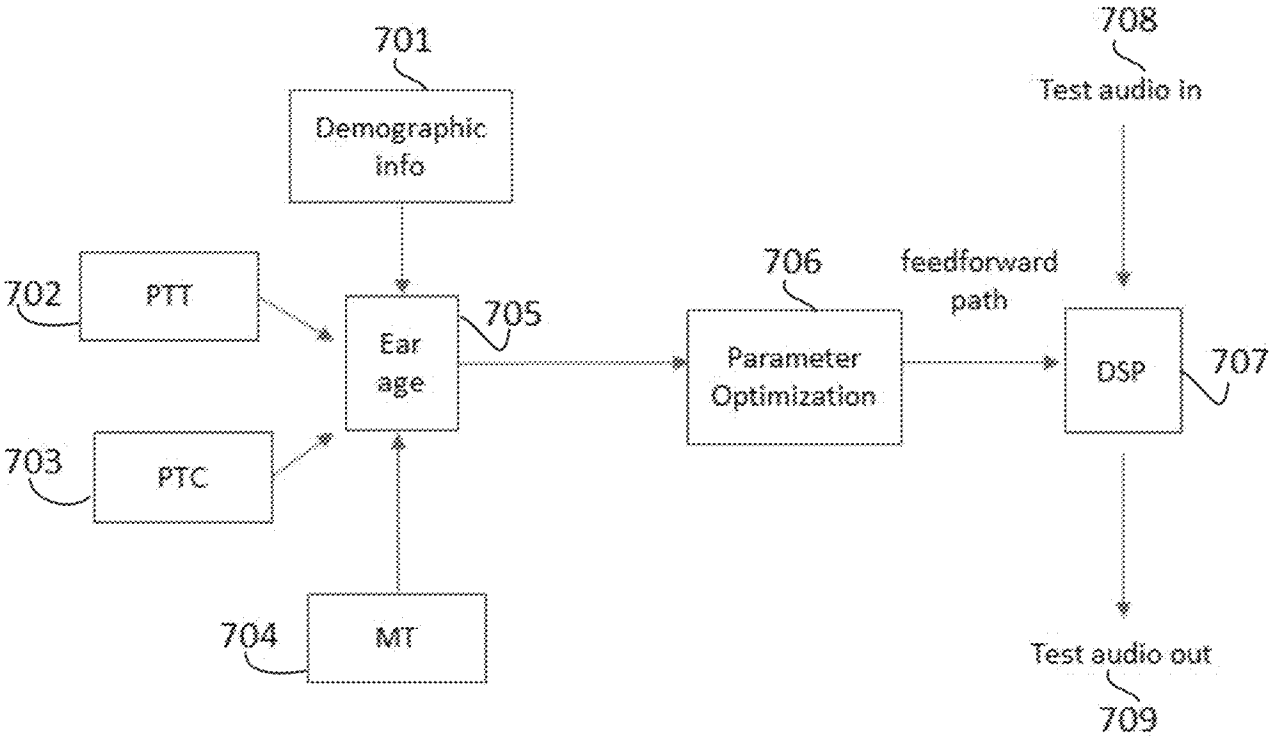
FIG. 7 illustrates a flow chart of a typical feed forward approach to parameterisation.

FIG. 7 illustrates a flow chart of a method utilized for parameter adjustment for an audio signal processing device intended to improve perceptual quality. Hearing data is used to compute an "ear age", 705, for a particular user. User's ear age is estimated from a variety of data sources for this user, including: demographic information 701, pure tone threshold ("PTT") tests 702, psychophysical tuning curves ("FTC") 703, and/or masked threshold tests ("MT") 704. Parameters are adjusted 706 according to assumptions related to ear age 705 and are output to a DSP, 707. Test audio 708 is then fed into DSP 707 and output 709. To this extent, parameter adjustment relies on a 'guess, check and tweak' methodology—which can be imprecise, inefficient and time consuming.

Figure 8:
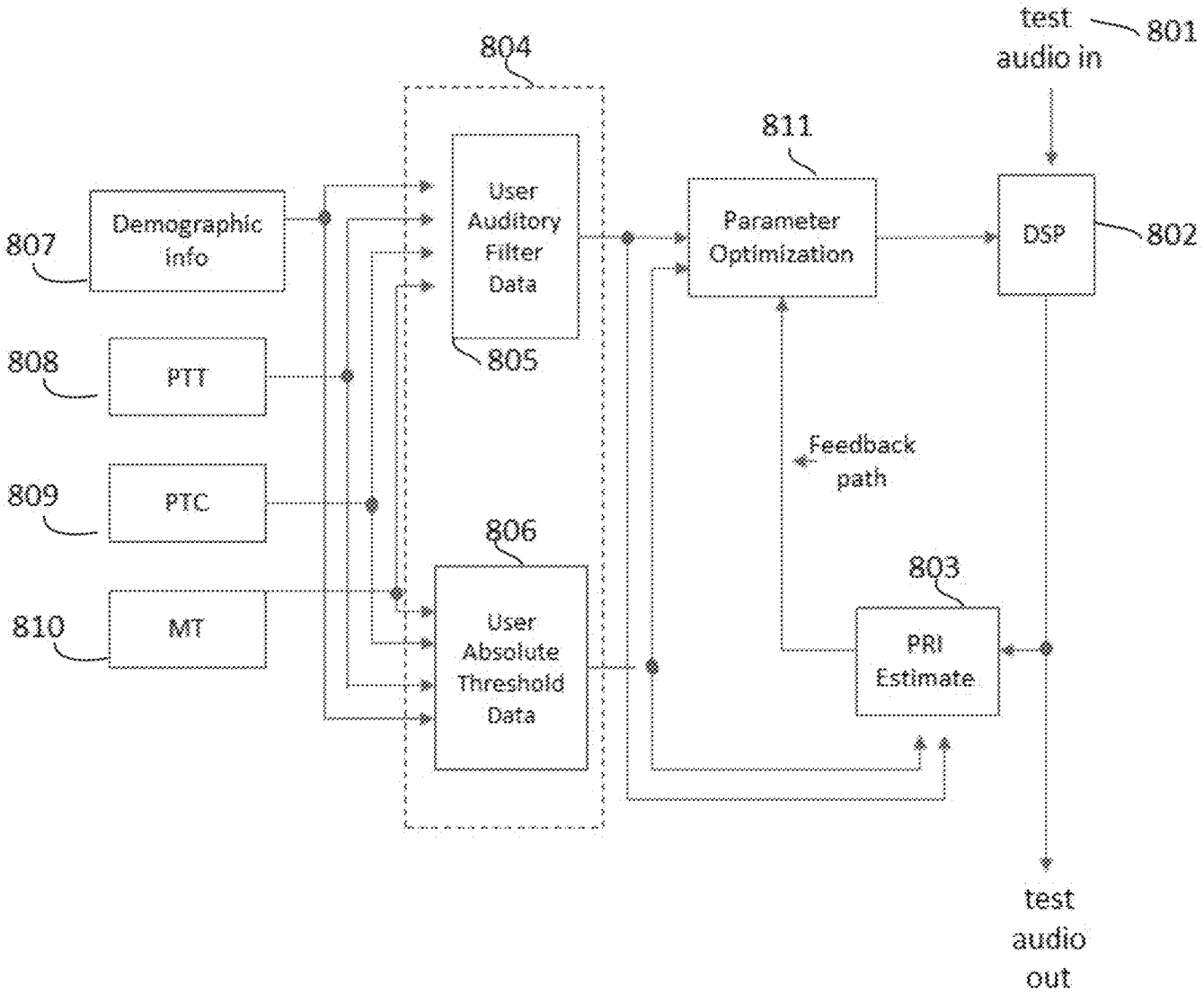
FIG. 8 illustrates a flow chart detailing a PRI approach to parameter optimization.

In order to more effectively parameterize a multiband dynamic processor, a PRI approach may be used. An audio sample, or body of audio samples 801, is first processed by a parameterized multiband dynamics processor 802 and the PRI of the processed output signal(s) is calculated 803 according to a user's hearing profile 804, FIG. 8. The hearing profile itself bears the masking and hearing thresholds of the particular user. The hearing profile may be derived from a user's demographic info 807, their PTT data 808, their PTC data 809, their MT data 810, a combination of these, or optionally from other sources. After PRI calculation, the multiband dynamic processor is re-parameterized according to a given set of parameter heuristics, derived from optimization 811, and from this the audio sample(s) is reprocessed and the PRI calculated. In other words, the multiband dynamics processor 802 is configured to process the audio sample so that it has an increased PRI for the particular listener, taking into account the individual listener's personal hearing profile. To this end, parameterization of the multiband dynamics processor 802 is adapted to increase the PRI of the processed audio sample over the unprocessed audio sample. The parameters of the multiband dynamics processor 802 are determined by an optimization process that uses PRI as its optimization criterion. The above approach for processing an audio signal based on optimizing PRI and taking into account a listener's hearing characteristics may not only be based on multiband dynamic processors, but any kind of parameterized audio processing function that can be applied to the audio sample and its parameters determined so as to optimize PRI of the audio sample.

The parameters of the audio processing function may be determined for an entire audio file, for corpus of audio files, or separately for portions of an audio file (e.g. for specific frames of the audio file). The audio file(s) may be analyzed before being processed, played or encoded. Processed and/or encoded audio files may be stored for later usage by the particular listener (e.g. in the listeners audio archive). For example, an audio file (or portions thereof) encoded based on the listener's hearing profile may be stored or transmitted to a far-end device such as an audio communication device (e.g. telephone handset) of the remote party. Alternatively, an audio file (or portions thereof) processed using a multiband dynamic processor that is parameterized according to the listener's hearing profile may be stored or transmitted.

Various optimization methods are possible to maximize the PRI of the audio sample, depending on the type of the applied audio processing function such as the above mentioned multiband dynamics processor. For example, a subband dynamic compressor may be parameterized by compression threshold, attack time, gain and compression ratio for each subband, and these parameters may be determined by the optimization process. In some cases, the effect of the multiband dynamics processor on the audio signal is nonlinear and an appropriate optimization technique is required. The number of parameters that need to be determined may become large, e.g. if the audio signal is processed in many subbands and a plurality of parameters needs to be determined for each subband. In such cases, it may not be practicable to optimize all parameters simultaneously and a sequential approach for parameter optimization may be applied. Although sequential optimization procedures do not necessarily result in the optimum parameters, the obtained parameter values result in increased PRI over the unprocessed audio sample, thereby improving the user's listening experience.

Figure 9:
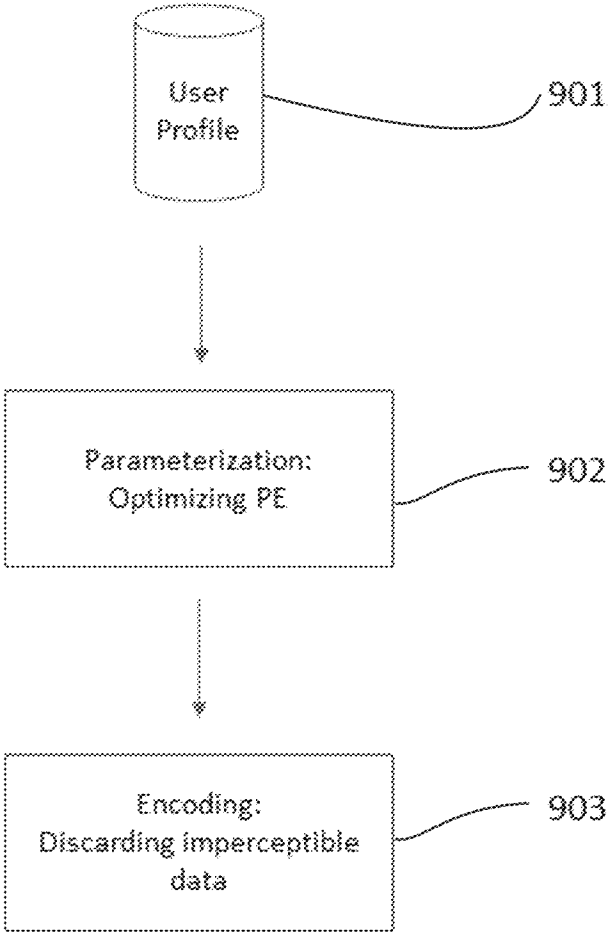
FIG. 9 illustrates a flow chart detailing perceptual entropy parameter optimization followed by perceptual coding.

FIG. 9 illustrates a flow chart detailing how one may optimize first for PRI 902 based on a user's hearing profile 901, and then encode the file 903, utilizing the newly parameterized multiband dynamic processor to first process the audio file and then encode it, discarding any remaining perceptually irrelevant information. This has the dual benefit of first increasing PRI for the hearing impaired individual, thus adding perceived clarity, while also still reducing the audio file size.

In the following, a method is proposed to derive a pure tone threshold from a psychophysical tuning curve using an uncalibrated audio system. This allows the determination of a user's hearing profile without requiring a calibrated test system. For example, the tests to determine the PTC of a listener and his/her hearing profile can be made at the user's home using his/her personal computer, tablet computer, or smartphone. The hearing profile that is determined in this way can then be used in the above audio processing techniques to increase coding efficiency for an audio signal or improve the user's listening experience by selectively processing (frequency) bands of the audio signal to increase PRI.

Figure 10:
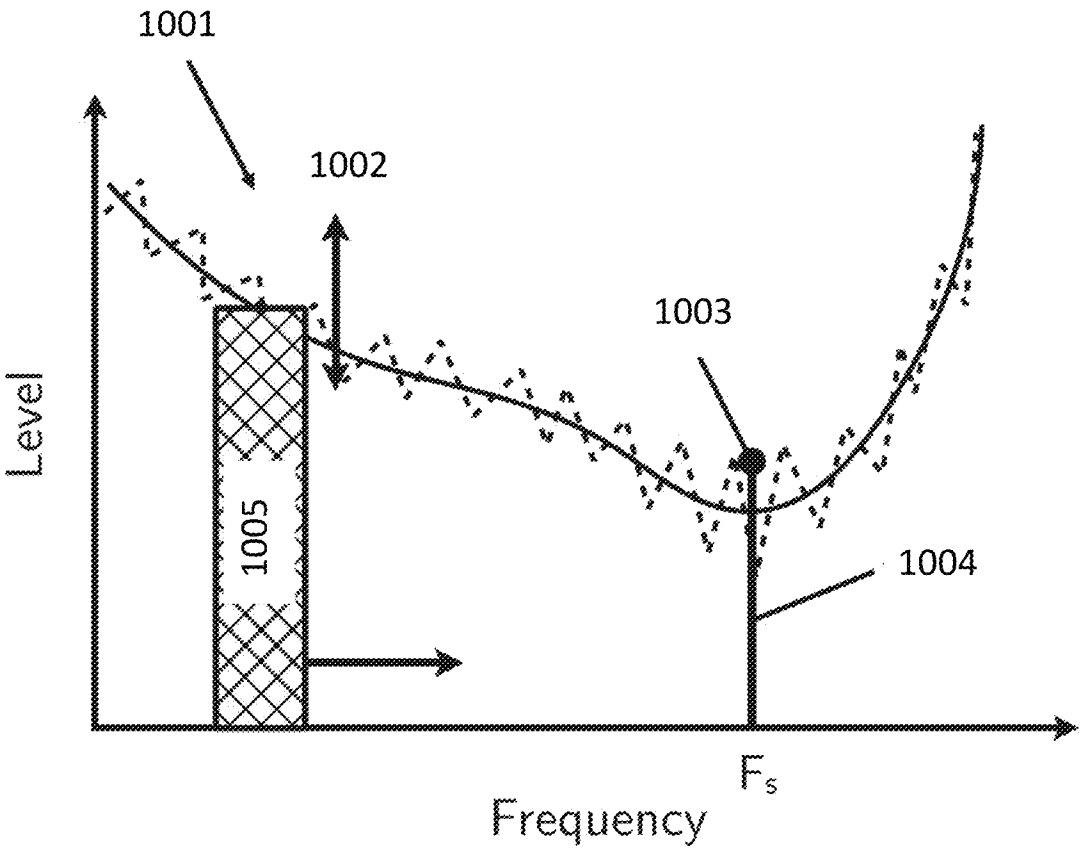
FIG. 10 shows an illustration of a PTC measurement.

FIG. 10 shows an illustration of a PTC measurement. A signal tone 1003 is masked by a masker signal 1005 particularly when sweeping through a frequency range in the proximity of the signal tone 1003. The test subject indicates at which sound level he/she hears the signal tone for each masker signal. The signal tone and the masker signal are well within the hearing range of the person. The diagram shows on the x-axis the frequency and on the y-axis the audio level or intensity in arbitrary units. While a signal tone 1003 that is constant in frequency and intensity 1004 is played to the person, a masker signal 1005 slowly sweeps from a frequency lower to a frequency higher than the signal tone 1003. The rate of sweeping is constant or can be controlled by the test subject or the operator. The goal for the test subject is to hear the signal tone 1003. When the test subject does not hear the signal tone 1003 anymore (which is for example indicated by the test subject by releasing a push button), the masker signal intensity 1002 is reduced to a point where the test subject starts hearing the signal tone 1003 (which is for example indicated by the user by pressing the push button). While the masker signal tone 1005 is still sweeping upwards in frequency, the intensity 1002 of the masker signal 1005 is increased again, until the test subject does not hear the signal tone 1003 anymore. This way, the masker signal intensity oscillates around the hearing level 1001 (as indicated by the solid line) of the test subject with regard to the masker signal frequency and the signal tone. This hearing level 1001 is well established and well known for people having no hearing loss. Any deviations from this curve indicate a hearing loss (see for example FIG. 11).

Figure 11:
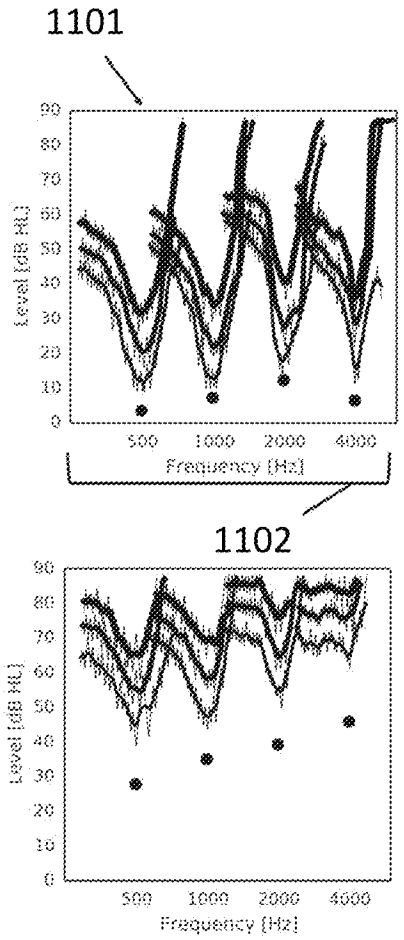
FIG. 11 shows PTC test results acquired on a calibrated setup in order to generate a training set.

FIG. 11 shows the test results acquired with a calibrated setup in order to generate a training set for training of a classifier that predicts pure-tone thresholds based on PTC features of an uncalibrated setup. The classifier may be, e.g., a linear regression model. Therefore, the acquired PTC tests can be given in absolute units such as dB HL. However, this is not crucial for the further evaluation. In the present example, four PTC tests at different signal tone frequencies (500 Hz, 1 kHz, 2 kHz and 4 kHz) and at three different sound levels (40 dB HL, 30 dB HL and 20 dB HL; indicated by the line weight; the thicker the line the lower the signal tone level) for each signal tone have been performed. Therefore, at each signal tone frequency, there are three PTC curves. The PTC curves each are essentially v-shaped. Dots below the PTC curves indicate the results from a calibrated—and thus absolute—pure tone threshold test performed with the same test subject. On the upper panel 1101, the PTC results and pure tone threshold test results acquired from a normal hearing person are shown (versus the frequency 1102), wherein on the lower panel, the same tests are shown for a hearing impaired person. In the example shown, a training set comprising 20 persons, both normal hearing and hearing impaired persons, has been acquired.

Figure 12:
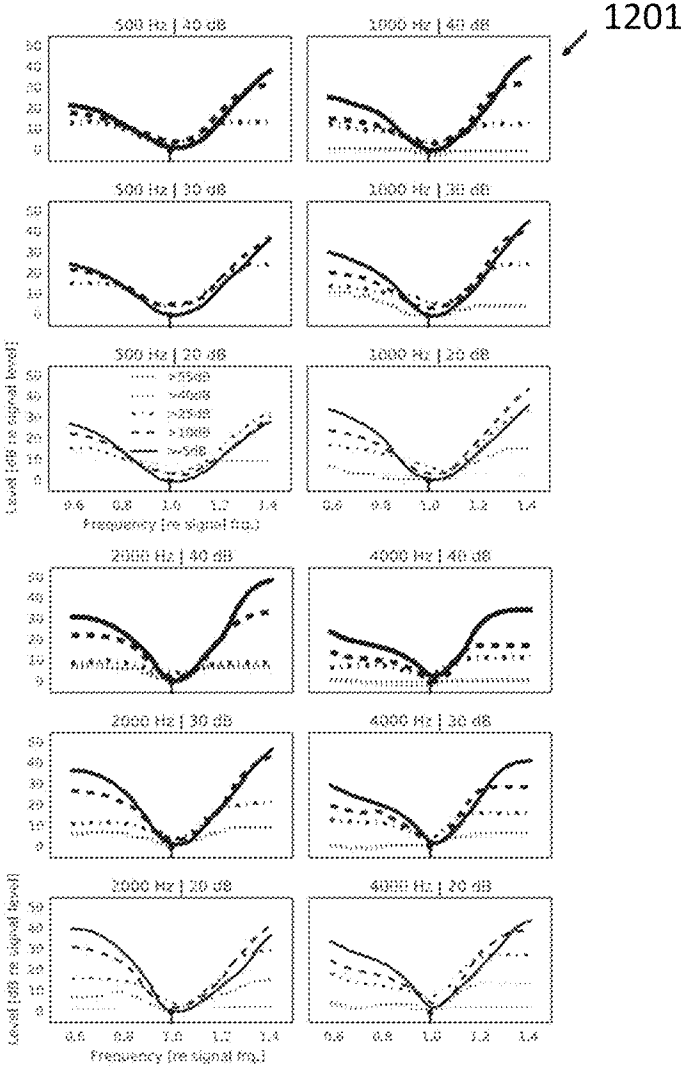
FIG. 12 shows a summary of PTC test results.

In FIG. 12 a summary of PTC test results of a training set are shown 1201. The plots are grouped according to single tone frequency and sound level resulting in 12 panels. In each panel the PTC results are grouped in 5 groups (indicated by different line styles), according to their associated pure tone threshold test result. In some panels pure tone thresholds were not available, so these groups could not be established. The groups comprise the following pure tone thresholds indicated by line colour: thin dotted line: >55 dB, thick dotted line: >40 dB, dash-dot line>25 dB, dashed line: >10 dB and continuous line: >−5 dB. The PTC curves have been normalized relative to signal frequency and sound level for reasons of comparison. Therefore, the x-axis is normalized with respect to the signal tone frequency. The x-axes and y-axes of all plots show the same range. As can easily be discerned across all graphs, elevations in threshold gradually coincide with wider PTCs, i.e. hearing impaired (HI) listeners have progressively broader tuning compared to normal hearing (NH) subjects. This qualitative observation can be used for quantitatively determining at least one pure tone threshold from the shape-features of the PTC. Modelling of the data may be realised using a multivariate linear regression function of individual pure tone thresholds against corresponding PTCs across listeners, with separate models fit for each experimental condition (i.e. for each signal tone frequency and sound level). To capture the dominant variabilities of the PTCs across listeners—and in turn reduce dimensionality of the predictors, i.e. to extract a characterizing parameter set—PTC traces are subjected to a principle component analysis (PCA). Including more than the first five PCA components does not improve predictive power.

Figure 13:
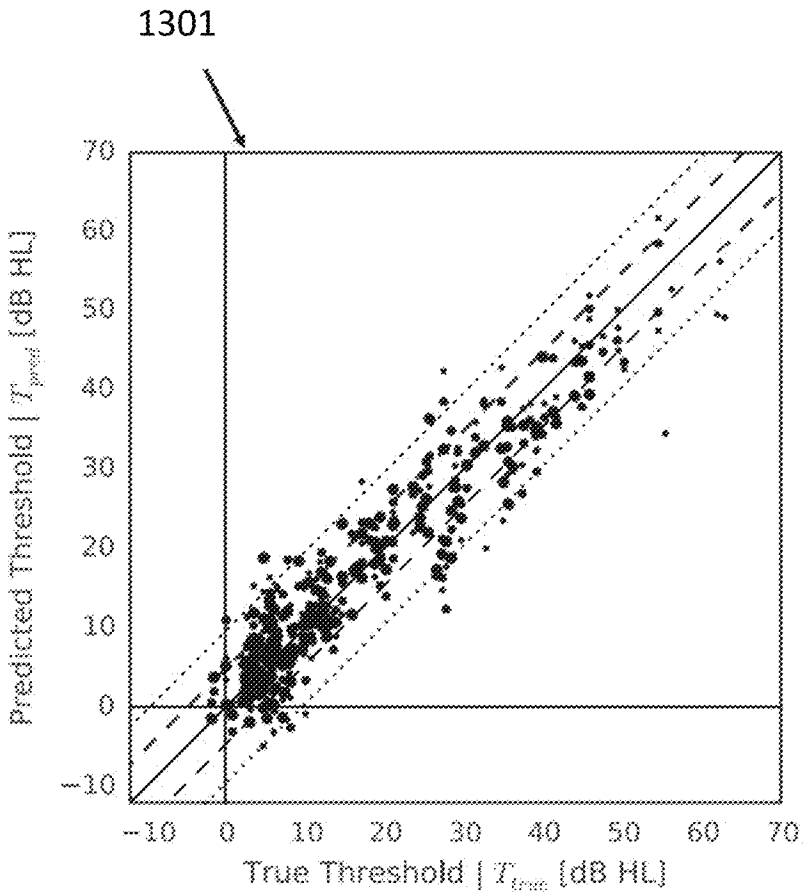
FIG. 13 summarizes fitted models' threshold predictions.

FIG. 13 summarizes the fitted models' threshold predictions. Across all listeners and conditions, the standard absolute error of estimation amounted to 4.8 dB, 89% of threshold estimates were within standard 10 dB variability. Plots of regression weights across PTC masker frequency indicate that mostly low-, but also high-frequency regions of a PTC trace are predictive of corresponding thresholds. Thus, with the such generated regression function it is possible to determine an absolute pure tone threshold from an uncalibrated audio-system, as particularly the shape-feature of the PTC can be used to conclude from a PTC of unknown absolute sound level to the absolute pure tone threshold. FIG. 13 shows 1301 the PTC-predicted vs. true audiometric pure tone thresholds across all listeners and experimental conditions (marker size indicates the PTC signal level). Dashed (dotted) lines represent unit (double) standard error of estimate.

Figure 14:
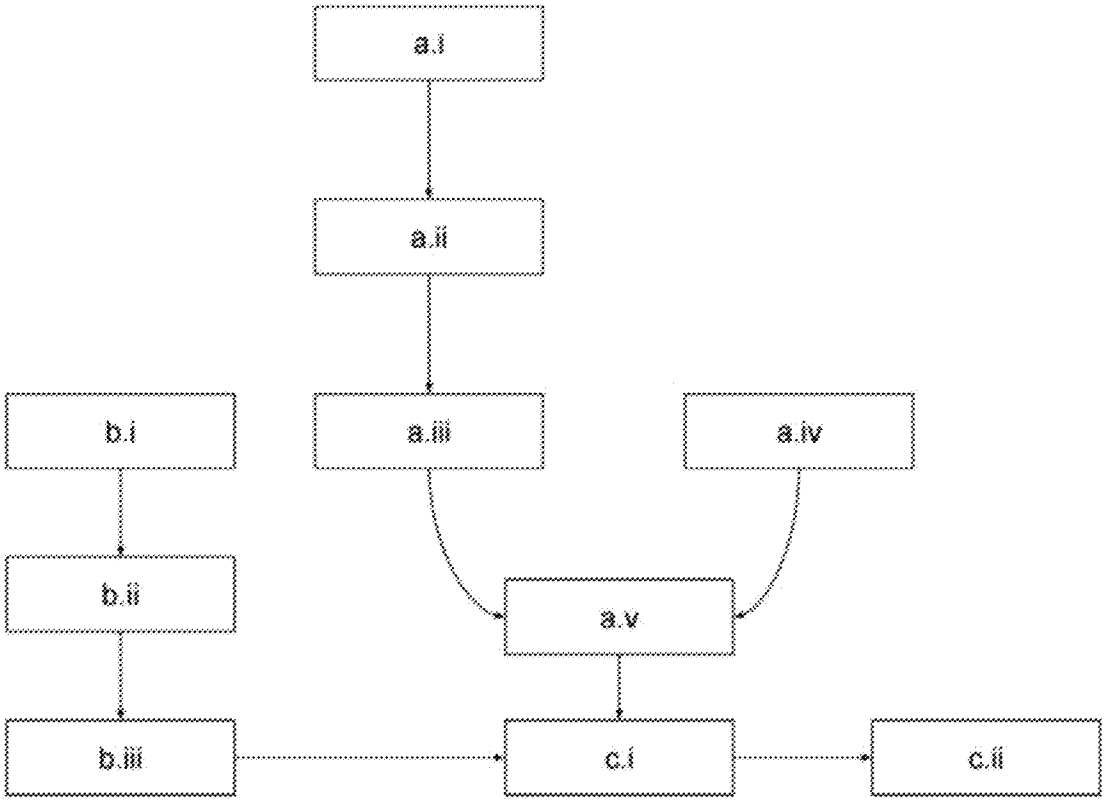
FIG. 14 shows a flow diagram of a method to predict pure-tone thresholds.

FIG. 14 shows a flow diagram of the method to predict pure-tone thresholds based on PTC features of an uncalibrated setup. First, a training phase is initiated, where on a calibrated setup, PTC data are collected (step a.i). In step a.ii these data are pre-processed and then analysed for PTC features (step a.iii). The training of the classifier (step a.v) takes the PTC features (also referred to as characterizing parameters) as well as related pure-tone thresholds (step a.iv) as input. The actual prediction phase starts with step b.i, in which PTC data are collected on an uncalibrated setup. These data are pre-processed (step b.ii) and then analysed for PTC features (step b.iii). The classifier (step c.i) using the setup it developed during the training phase (step a.v) predicts at least one pure-tone threshold (step c.ii) based on the PTC features of an uncalibrated setup.

Figure 15:
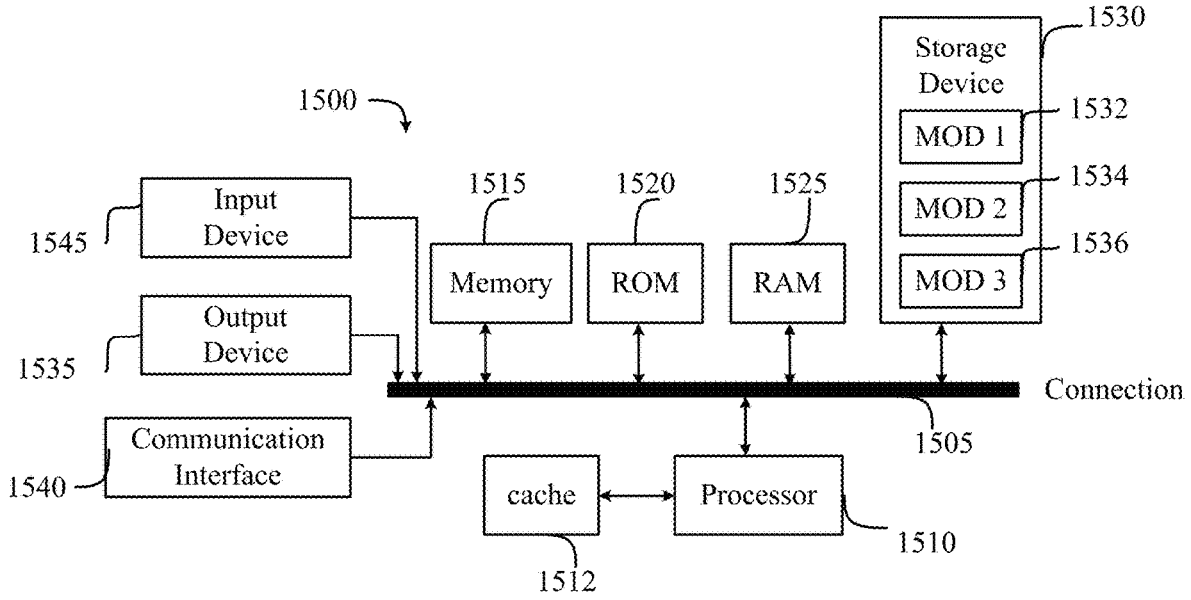
FIG. 15 shows an example of a system for implementing certain aspects of the present technology.

FIG. 15 shows an example of computing system 1500 (e.g., audio device, smart phone, etc.) in which the components of the system are in communication with each other using connection 1505. Connection 1505 can be a physical connection via a bus, or a direct connection into processor 1510, such as in a chipset architecture. Connection 1505 can also be a virtual connection, networked connection, or logical connection.

In some embodiments computing system 1500 is a distributed system in which the functions described in this disclosure can be distributed within a datacenter, multiple datacenters, a peer network, etc. In some embodiments, one or more of the described system components represents many such components each performing some or all of the function for which the component is described. In some embodiments, the components can be physical or virtual devices.

Example system 1500 includes at least one processing unit (CPU or processor) 1510 and connection 1505 that couples various system components including system memory 1515, such as read only memory (ROM) and random access memory (RAM) to processor 1510. Computing system 1500 can include a cache of high-speed memory connected directly with, in close proximity to, or integrated as part of processor 1510.

Processor 1510 can include any general purpose processor and a hardware service or software service, such as services 1532, 1534, and 1536 stored in storage device 1530, configured to control processor 1510 as well as a special-purpose processor where software instructions are incorporated into the actual processor design. Processor 1510 may essentially be a completely self-contained computing system, containing multiple cores or processors, a bus, memory controller, cache, etc. A multi-core processor may be symmetric or asymmetric.

To enable user interaction, computing system 1500 includes an input device 1545, which can represent any number of input mechanisms, such as a microphone for speech, a touch-sensitive screen for gesture or graphical input, keyboard, mouse, motion input, speech, etc. In some examples, the input device can also include audio signals, such as through an audio jack or the like. Computing system 1500 can also include output device 1535, which can be one or more of a number of output mechanisms known to those of skill in the art. In some instances, multimodal systems can enable a user to provide multiple types of input/output to communicate with computing system 1500. Computing system 1500 can include communications interface 1540, which can generally govern and manage the user input and system output. In some examples, communication interface 1540 can be configured to receive one or more audio signals via one or more networks (e.g., Bluetooth, Internet, etc.). There is no restriction on operating on any particular hardware arrangement and therefore the basic features here may easily be substituted for improved hardware or firmware arrangements as they are developed.

Storage device 1530 can be a non-volatile memory device and can be a hard disk or other types of computer readable media which can store data that are accessible by a computer, such as magnetic cassettes, flash memory cards, solid state memory devices, digital versatile disks, cartridges, random access memories (RAMs), read only memory (ROM), and/or some combination of these devices.

The storage device 1530 can include software services, servers, services, etc., that when the code that defines such software is executed by the processor 1510, it causes the system to perform a function. In some embodiments, a hardware service that performs a particular function can include the software component stored in a computer-readable medium in connection with the necessary hardware components, such as processor 1510, connection 1505, output device 1535, etc., to carry out the function.

For clarity of explanation, in some instances the present technology may be presented as including individual functional blocks including functional blocks comprising devices, device components, steps or routines in a method embodied in software, or combinations of hardware and software.

The presented technology offers a novel way of encoding an audio file, as well as parameterizing a multiband dynamics processor, using custom psychoacoustic models. It is to be understood that the present invention contemplates numerous variations, options, and alternatives. The present invention is not to be limited to the specific embodiments and examples set forth herein.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can comprise, for example, instructions and data which cause or otherwise configure a general purpose computer, special purpose computer, or special purpose processing device to perform a certain function or group of functions. Portions of computer resources used can be accessible over a network. The computer executable instructions may be, for example, binaries, intermediate format instructions such as assembly language, firmware, or source code. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can comprise hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are means for providing the functions described in these disclosures.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims. Moreover, claim language reciting "at least one of" a set indicates that one member of the set or multiple members of the set satisfy the claim.

The invention claimed is:

1. A method for modifying an audio signal for encoding the audio signal, the method comprising:

obtaining a hearing profile;

splitting a sample of the audio signal into frequency acomponents;

obtaining masking thresholds from the hearing profile;

obtaining hearing thresholds from the hearing profile;

applying the masking and hearing thresholds to the frequency components and disregarding an imperceptible audio signal data;

quantizing the audio signal; and encoding the audio signal.

2. The method according to claim 1, wherein the hearing profile is derived from at least one of a suprathreshold test, a psychophysical tuning curve, a threshold test and an audiogram.

3. The method according to claim 1, wherein the hearing profile is estimated from demographic information.

4. The method according to claim 1, wherein the hearing profile is derived from a psychophysical tuning curve and an audiogram.

5. The method according to claim 4, wherein the audiogram is derived from the psychophysical tuning curve.

6. The method according to claim 1, wherein the masking thresholds and hearing thresholds are applied to the frequency components of the audio signal and perceptual relevant information is calculated for the audio signal that is perceptually relevant.

7. The method according to claim 6, wherein perceptually relevant information is calculated by calculating perceptual entropy.

8. The method according to claim 1, further comprising:

applying a parameterized processing function to the audio signal before the splitting of the sample of the audio signal into the frequency components, the parameterized processing function operating on subband signals of the audio signal.

9. The method according to claim 8, further comprising:

determining processing parameters of the parameterized processing function, wherein the determining comprising a sequential determination of subsets of the processing parameters, each subset determined so as to optimize perceptual relevant information for the audio signal.

10. The method according to claim 8, further comprising:

selecting a subset of the subbands signals of the audio signal so that masking interaction between the selected subbands is minimized; and determining processing parameters for the selected subbands.

11. The method according to claim 8, wherein processing parameters are determined sequentially for each subband of the subband signals of the audio signal.

12. The method according to claim 8, wherein the processing function is a multiband compression of the audio signal and parameters of the processing function comprise at least one of a threshold, a ratio, and a gain.

13. The method according to claim 1, wherein an output audio device is selected from a list comprising a mobile phone, a computer, a television, a pair of headphones, a hearing aid or a speaker system.

14. An audio processing device comprising:

a processor; and a memory storing instructions, which when executed by the processor, causes the processor to:

obtain a hearing profile;

split a sample of the audio signal into frequency components;

obtain masking thresholds from the hearing profile;

obtain hearing thresholds from the hearing profile;

apply the masking and hearing thresholds to the frequency components and disregarding an imperceptible audio signal data;

quantize the audio signal; and encode the audio signal.

15. A non-transitory computer readable storage medium storing a instructions which when executed by a processor of an audio processing device, causes the processor to:

obtain a hearing profile;

split a sample of the audio signal into frequency components;

obtain masking thresholds from the hearing profile;

obtain hearing thresholds from the hearing profile;

apply the masking and hearing thresholds to the frequency components and disregarding an imperceptible audio signal data;

quantize the audio signal; and encode the audio signal.

* * * * *